US005533572A

United States Patent [19]

Brady et al.

[11] Patent Number: 5,533,572

[45] Date of Patent: Jul. 9, 1996

[54] SYSTEM AND METHOD FOR MEASURING CORROSION IN WELL TUBING

[75] Inventors: Jerry L. Brady; Stephen Gerlek, both of Anchorage; David L. Lagerlef, Eagle River, all of Ak.; Raymond Wydrinski, Lewisville, Tex.

[73] Assignee: Atlantic Richfield Company, Los Angeles, Calif.

[21] Appl. No.: 370,689

[22] Filed: Jan. 10, 1995

Related U.S. Application Data

[63] Continuation-in-part of Ser. No. 263,594, Jun. 22, 1994, and Ser. No. 276,976, Jul. 19, 1994.

[51] Int. Cl.[6] ..... E21B 47/00

[52] U.S. Cl. ..... 166/250.05; 204/404

[58] Field of Search ..... 166/250, 248, 166/60, 250.05; 204/153.11, 404

[56] References Cited

U.S. PATENT DOCUMENTS

| | | | |
|---|---|---|---|
| 3,947,329 | 3/1976 | Seyl | 204/404 X |
| 4,412,585 | 11/1983 | Bouck | 166/60 X |
| 4,784,729 | 11/1988 | Jasinski | 204/153.11 X |
| 4,837,518 | 6/1989 | Gard et al. . | |
| 4,840,719 | 6/1989 | Jasinski | 204/404 |
| 5,012,868 | 5/1991 | Bridges | 166/60 X |
| 5,405,513 | 4/1995 | Lewis, II et al. | 204/153.11 |

*Primary Examiner*—William P. Neuder
*Attorney, Agent, or Firm*—Michael E. Martin

[57] ABSTRACT

Corrosion in well tubing strings, pipe and similar conduits may be determined by a circuit which includes a current sensitive meter and a known voltage source which is placed at selected intervals in the tubing string to make current flow measurements and voltage drop measurements between spaced apart contactors engaged with the tubing string at the selected intervals. The current flow measurements from the known source are used to determine resistance of the measured interval and voltage drop from a second source imposed on the tubing string at the surface is measured at the selected intervals to determine current flow from the second source. The differences in current flow at the selected intervals at a first measurement are compared with the differences in current flow at the same intervals at a later time to indicate any changes in current flow which may be related to corrosion in the tubing string between the intervals of measurement. The circuits may be placed in gas lift valve assemblies at spaced apart gas lift mandrels in the tubing string and signals related to current flow and voltage transmitted to the surface by stress wave telemetry or electromagnetic waves transmitted through the earth, for example. The circuits may also be interposed in selected sections of tubing spaced apart in the tubing string or on an instrument carrier apparatus which may be selectively positioned in the tubing string by a coiled tubing conveyed or wire line conveyed running tool.

32 Claims, 4 Drawing Sheets

SYSTEM AND METHOD FOR MEASURING CORROSION IN WELL TUBING

CROSS REFERENCE TO RELATED APPLICATIONS

This application is a continuation-in-part of U.S. patent application Ser. No. 08/263,594 filed Jun. 22, 1994 and U.S. patent application Ser. No. 08/276,976 filed Jul. 19, 1994.

FIELD OF THE INVENTION

The present invention pertains to a system and method for measuring corrosion in well tubing and other metal conduit or pipe by measuring changes in electrical resistivity of predetermined sections of the tubing or conduit at selected intervals and using instruments that may be placed at the selected intervals in the tubing or conduit.

BACKGROUND

In the production of oil and gas and activities pertaining thereto, corrosion of well tubing and related conduits for conducting oil and gas, or fluids injected into the earth to stimulate the production of oil and gas, is a continuing problem. For example, in crude oil production from wells which extend several thousand feet into the earth, corrosive activity may be occurring at various intervals in the production tubing strings, for example. It is important to be able to monitor this corrosion so that remedial action may be taken to replace the corroded tubing sections or by carrying out a suitable process to prevent further corrosive activity from occurring which might result in tubing failure. However, detecting corrosion in a tubing string which extends hundreds or thousands of feet into the earth, without withdrawing the tubing string from the well, has heretofore required conveying tools on cables, sometimes known as wirelines, through the tubing string to be inspected. These processes are complicated and expensive and in some wells have been virtually impossible to carry out.

The above-referenced U.S. patent applications, both assigned to the assignee of the present invention, contemplate the placement of certain sensing or measuring devices in a fluid production well. One advantageous point of placement of sensors has been determined to be that wherein suitable devices are disposed on retrievable gas lift valve assemblies which may be inserted into the well tubing and disposed in spaced apart sections of tubing known as side pocket mandrels. Typically, fluid production wells which are utilizing gas to assist in lifting production liquids to the surface through the production tubing string employ a plurality of gas lift valve assemblies disposed in spaced apart tubing sections comprising the above-mentioned mandrels. Accordingly, the present invention takes advantage of the concept of placing a particular type of sensor on a gas lift valve assembly which may be interposed in a well tubing string. Since several gas lift mandrels, up to twenty, for example, are typically spaced throughout the length of a production tubing string for an oil production well, these devices can serve as a point of placement of a suitable sensing system which may be used to measure corrosive activity on the tubing string including the gas lift mandrels themselves.

The prior development of unique arrangements of downhole sensors for use in measuring certain properties of fluids flowing within deep wells has also fostered the development of an arrangement wherein predetermined sections of the tubing or casing making up the well structure may be monitored by a suitable instrument assembly to determine if corrosion is occurring at selected points within a well. It is to these ends that the present invention has been developed.

SUMMARY OF THE INVENTION

The present invention provides a unique system for measuring corrosion in well tubing and similar conduits. The present invention also provides a unique method for measuring corrosion in well tubing and similar conduits which does not require removal of the tubing or conduit from its working position, or interfere with the normal operation thereof, such as in running wireline conveyed tools through well tubing and casing.

In accordance with one important aspect of the present invention, corrosive activity in well tubing may be monitored by placing unique measuring instruments in predetermined positions in a tubing string and, from time to time, determining a change in electrical current flow at selected points in the tubing string to determine any changes in resistivity at and between the selected points, which activity can be correlated with corrosion of the tubing.

In accordance with one embodiment of the invention, a unique instrument may be interposed in a gas lift valve assembly and disposed in a preselected position in a tubing string of a well which has one or more gas lift valves interposed in the production tubing string. The instrument is arranged such that the gas lift valve assembly establishes electrical contact with the tubing string at spaced apart points in the gas lift valve receiving mandrel whereby the electrical resistance of the mandrel between the contact points is measured and then a voltage differential along the interval between the contact points is measured to determine current flow through that portion of the tubing string. Measurements made at spaced apart intervals in the tubing string enable a determination of any change in electrical resistance of the tubing string between the intervals, which change may be attributed to corrosion of the tubing string.

In accordance with another important aspect of the invention, a downhole current and voltage measuring system is provided which may be interposed in a well tubing string at a particular section of the tubing string, or as part of an instrument array which may be deployed in the wellbore. The instrument array may thus be adapted for measuring corrosion and/or other activities occurring in the wellbore, such as the properties of fluids flowing through the wellbore. Multiple functions may be carried out by the instrument array, simultaneously. Electrical power for operating the system and instruments may be supplied by suitable batteries in place with the instruments, by a conductor interposed in a retrievable tubing which is lowered into the wellbore or by a downhole generator which is driven by fluid flowing through the wellbore.

The method and systems of the invention provide for improved monitoring of corrosion of well conduits, in particular. Wells which are operated by rod actuated pumps and electric motor driven submersible pumps may also be modified to include tubing mandrels which have pockets, for example, for receiving a removable "dummy" valve body which includes the corrosion measuring system as well as other measurement devices. However, the systems and method may also be used in conjunction with conduits which are otherwise inaccessible with respect to monitoring corrosive activity thereon, such as fluid transmission pipelines.

The above-mentioned features of the invention together with other superior aspects thereof will be further appreciated by those skilled in the art upon reading the detailed description which follows in conjunction with the drawing.

DESCRIPTION OF PREFERRED EMBODIMENTS

Figures 1, 2:
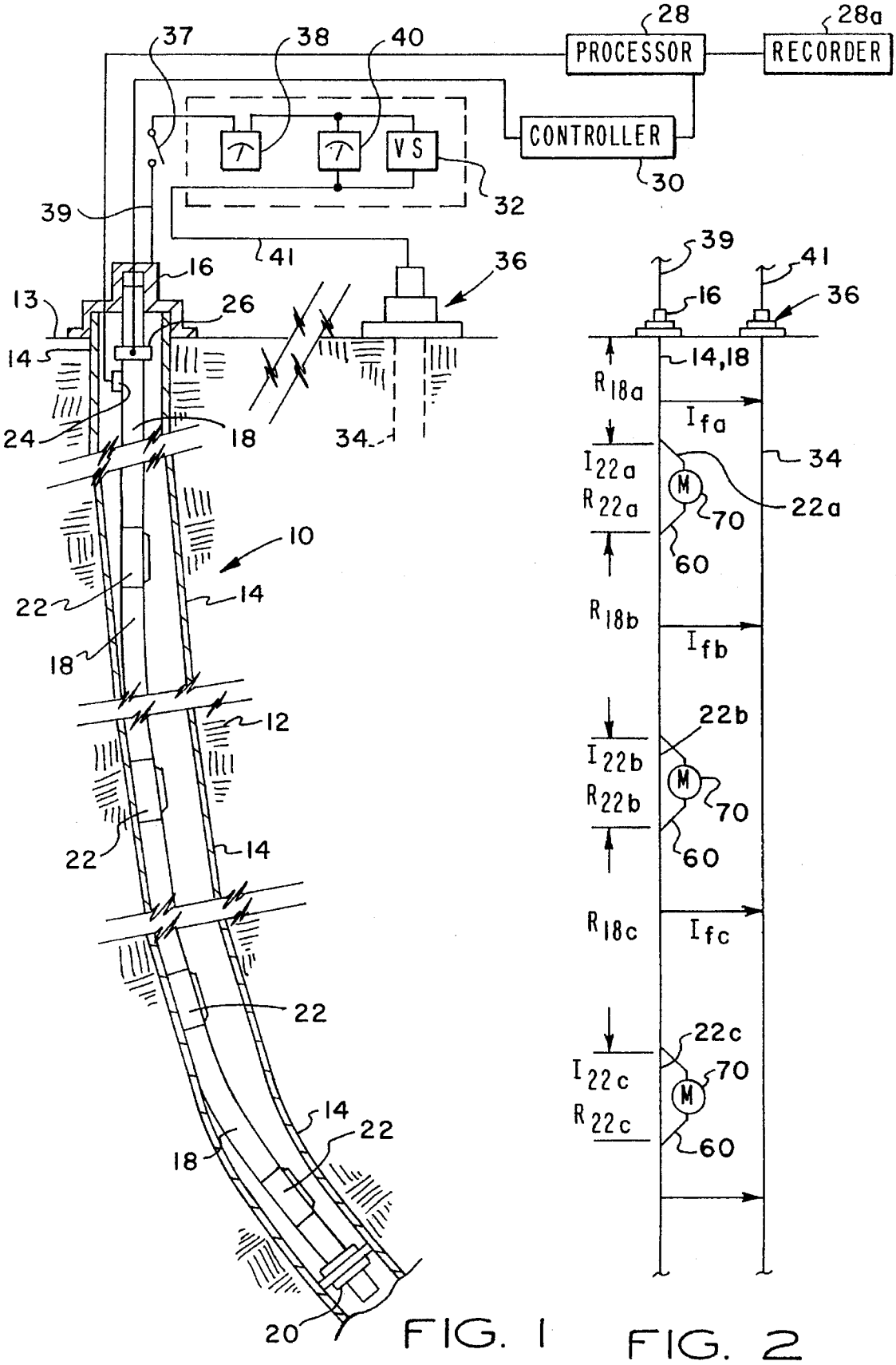
FIG. 1 is a schematic diagram of a somewhat deviated, cased well which has been modified to be monitored by the system and method of the invention.
FIG. 2 is a schematic diagram illustrating the method of the invention.

In the description which follows like parts are marked throughout the specification and drawing with the same reference numerals, respectively. The drawing figures are not necessarily to scale in the interest of clarity and conciseness.

Referring to FIG. 1, there is illustrated a fluid production well, generally designated by the numeral 10, extending within an earth formation 12 in a somewhat deviated or non-vertical direction. The well 10 is provided with a conventional metal casing 14 extending from a metal wellhead 16. An elongated fluid production tubing string 18 extends within the casing 14 between the wellhead 16 and a conventional packer 20, for example. The tubing 18 has a plurality of spaced apart, conventional gas lift mandrels 22 interposed therein whereby pressure gas may be injected down through the casing 14 from a source, not shown, to flow through suitable gas lift valves in each of the mandrels, and which will be discussed in further detail herein, to assist in lifting fluid through the tubing string to the surface. As indicated in FIG. 1, the tubing string 18 is in contact with the casing 14 over a substantial portion of its length due to the deviation of the well 10 from a vertical direction. In many wells the production tubing string is in contact with the casing at various points therealong or over a major portion of the tubing length although, ideally, true vertical wells may not have the production tubing string in contact with the casing except at certain support points such as the packer 20.

The well 10 illustrated in FIG. 1 has been modified to provide for determining corrosive activity on the tubing string 18 at selected points therealong in accordance with a system and method to be described in further detail herein. Part of the system and method of the invention utilizes a signal sensing and transmitting system which includes a sensor 24 connected to the tubing string 22 near the wellhead 16 and a signal generator or transmitter 26 disposed in the tubing string 18 also near the wellhead 16. The sensor 24 and transmitter 26 may be connected to the tubing string 22 at other positions therealong. The sensor 24 and the transmitter 26 are operably connected to interconnected signal processor and controller devices 28 and 30 for receiving signals transmitted through the tubing string 18 from the system of the invention and for transmitting signals within the tubing string to the system of the invention. The sensor 24, transmitter 26, processor 28 and controller 30 may be operable to transmit and receive electrical signals or, by way of example, may be in accordance with the teaching of U.S. Pat. No. 5,319,610 issued Jun. 7, 1994 to Tom P. Airhart and assigned to the assignee of the present invention. The sensor 24 may also be similar to that described in U.S. Pat. No. 4,715,451 or U.S. Pat. No. 5,038,614, both to A. A. Bseisu, and also assigned to the assignee of the present invention. The arrangement of the sensor or signal receiver 24, the transmitter 26 and the signal processor 28 and controller 30 are exemplary devices wherein an acoustic or so-called stress wave type signal may be transmitted through the tubing string 18 between devices which are interposed in the gas lift mandrels 22 and the devices 28 and 30 which are disposed at the earth's surface 13. In particular, in accordance with the present invention, signals related to voltage and current flow at selected intervals in the tubing string 18 are transmitted between the devices interposed in the gas lift mandrels 22 and the surface 13.

Referring further to FIG. 1, the well 10 is also operable to receive either a direct or a low frequency alternating electrical current provided from a source 32, which current is imposed on the tubing string 18 and the casing 14 at the wellhead 16. The circuit between the source 32 and the well 10 is completed through a suitable electrode or conductor 34 which may comprise the metal casing of a well 36 relatively near the well 10. The electrical source 32 is operable to impose, for example, a switched DC signal having a frequency in the range of about 0.01 Hz to 10 Hz, current flow ranging from 1.0 amps to 100.0 amps and voltage from about one hundred microvolts to one thousand microvolts. Current flow and voltage are measured by suitable meters 38 and 40, respectively. U.S. Pat. No. 4,837,518 to M. F. Gard et al. issued June 6, 1989 describes further details of a circuit similar to the circuit described hereinabove for the well 10. The source 32 is connected to the wellhead 16 and the conductor 34 at conductors 39 and 41, respectively. Suitable switch means 37 is interposed in the circuit as shown.

It is important to know if corrosive action is occurring on the tubing string 18. Typically, in oil production wells, such as those producing from the Prudhoe Bay Oilfield in Alaska, corrosive activity occurs on the inside wall of the production tubing string such as the tubing string 18. Typically, very little corrosive activity may occur with respect to the casing 14 and the electrical characteristics of the formation 12 are not considered to change appreciably with time. Corrosion may take place on the external wall surfaces of the tubing string 18. Since the method and apparatus of the present invention measures the total amount of corrosion, that is the combined internal and external corrosion, external corrosion may be determined by conveying a conventional internal corrosion measurement tool through the tubing string 18 before or after the measurements are made in accordance with the present invention. The internal corrosion measurements may then be subtracted from the total corrosion measurements to determine the amount of external corrosion, if any, occurring on the tubing string 18. It is, of course, desirable to be able to monitor the corrosive activity on the tubing string 18 so that it may be repaired or replaced, at least in part, before failure occurs. The present invention provides an improved method for making total corrosion measurements and takes advantage of an arrangement in tubing strings such as the tubing string 18 wherein spaced apart gas lift mandrels 22 are interposed in the tubing string.

Figure 3:
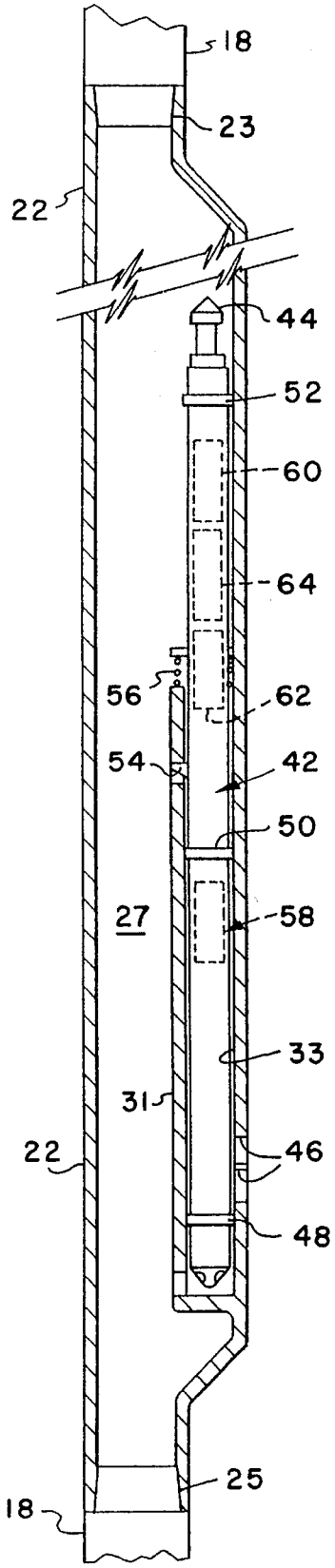
FIG. 3 is a detail section view of a gas lift mandrel including a gas lift valve assembly which has been modified in accordance with the system of the invention.

The mandrels 22 may be conventional and one is illustrated in longitudinal central section in FIG. 3. The mandrel 22 may, for example, be of a type sold under the trademark Tru-Guide™ by Halliburton Company, Dallas, Tex. The mandrel 22 comprises a section of the tubing string 18 and is interposed therein at suitable threaded connections 23 and 25. The mandrel 22 has an interior passage 27 for conducting fluids therethrough and a portion defined by a laterally spaced wall 29 which, together with an intermediate wall 31, forms a recess 33 for receiving an elongated, generally tubular shaped gas lift valve assembly 42. The valve assembly 42 is of a type which may be inserted in the recess 33 and retrieved therefrom using a commercially available tool which is operable to be connected to a head portion 44 of the valve assembly for deploying the valve assembly in the recess 33 and retrieving it therefrom. Suitable ports 46 are formed in the wall 29 for conducting gas into the recess 33 and through the valve assembly 42 for entry into the passage 27 to assist in lifting liquid through the tubing string 18.

The gas lift valve assembly 42 is provided with a combination lower seal and contactor 48 engageable with the walls defining the recess 33, an intermediate seal member 50 and a second contactor 52 disposed at the end of the valve assembly adjacent to the head 44. The contactors 48 and 52 may be annular metal rings suitably supported on a tubular body 43 of the valve assembly 42. The gas lift valve assembly 42 is operable to be latched into the recess 33 by a conventional latch 54 in a manner known to those skilled in the art. The latch 54 is urged into firm engagement with the intermediate wall 31 by a biasing spring 56 suitably disposed on the body 43 of the gas lift valve assembly.

Referring further to FIG. 3, the valve assembly 42 includes an acoustic or stress wave type signal transmitter 58 interposed therein and which will be described in further detail hereinbelow. The transmitter 58 could be modified to be of a type which transmits electrical signals to the surface via a suitable receiver instrument, not shown, in place of sensor 24. The valve assembly 42 also includes a unique circuit 60 disposed in the body 43 for measuring a voltage differential across the mandrel 22 between the contactors 48 and 52 and for measuring current flow through the mandrel between the contactors 48 and 52, to determine changes in resistance of certain portions of the tubing string, including the mandrel 22, in accordance with the invention. An acoustic signal controller 62 is interposed in the gas lift valve assembly 42 and an acoustic signal receiver and processor 64 is also disposed in the gas lift valve assembly 42. The signal processor 64 is operable to receive signals from the circuit 60 and transmit signals in suitable form to the controller 62 to control operation of the signal transmitter 58 for transmitting acoustic wave or so-called stress wave signals through the tubing string 18 to the sensor 24 and processor 28, such signals being related to the voltage and current flow measured by the circuit 60. The signal treating devices 62 and 64 may have their own sources of electrical power, not shown, and operable to control the transmitter 58, also. A suitable recorder 28a is operably connected to the processor 28 for storing signals received by the processor whereby appropriate calculations of changes in tubing and mandrel resistance may be carried out, at will.

Figure 4:
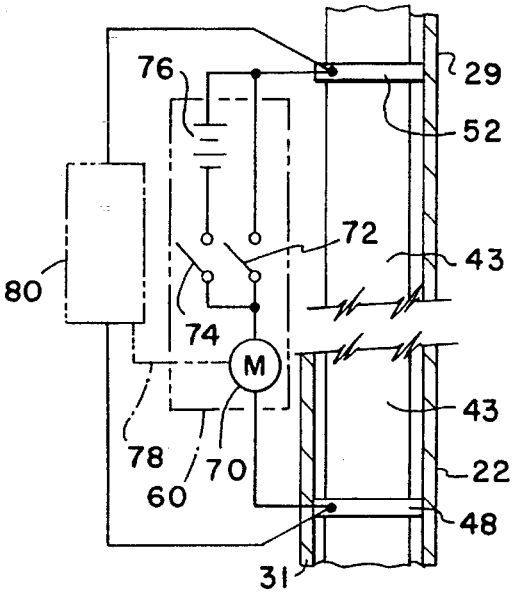
FIG. 4 is a schematic diagram of part of the gas lift valve assembly including a circuit for measuring tubing resistivity in accordance with the invention.

Referring now to FIG. 4, the circuit 60 is shown in somewhat simplified schematic form and includes a current sensitive meter 70 which is operable to measure current flow between the contactors 48 and 52 as well as a voltage differential between the contactors 48 and 52. The meter 70 may comprise two separate meters and is in circuit with independently operated switches 72 and 74 which may be remotely controlled to be open or closed, respectively. The switch 74 is in circuit with a voltage source 76 of substantially constant or controllable voltage. Suitable conductor means 78 are connected to the circuit 60 for reading the output of the meter 70 and for transmitting signals to control the switches 72 and 74. The conductor 78 may be operably connected to the signal processor 64, FIG. 3, or, alternatively as shown in FIG. 4, to a signal transmitter and receiver 80 of a type which is adapted to impose electromagnetic wave signals on the casing 14 by way of the tubing 18 and across the contactors 48 and 52 whereby signals output from the circuit 60 may be transmitted through the earth or the tubing 18 or casing 14 to the surface. Accordingly, one alternative mode of transmitting signals from the circuit 60 to the surface would be by electromagnetic wave energy transmitted substantially through the earth in accordance with methods known to those skilled in the art.

A method of determining corrosion in the tubing string 18 will now be described using the system described above and illustrated in FIGS. 1, 3 and 4. Referring to FIG. 2, the diagram illustrates a circuit which is operable to be connected to the source 32 in FIG. 1. Due to the contact between the tubing string 18 and the casing 14, these structures are considered to be a common conductor and any change in resistance of such conductor at selected points of measurement is considered, for the sake of this discussion, to be due to corrosion of the interior of the tubing string 18. Moreover, it is assumed that there is no change in the characteristics of the formation 12 through which current will flow between the conductor 14, 18 and the conductor 34. Thus, the electrical resistivity of the formation is considered to be constant. The method contemplates the determination of the electrical resistance of portions of the tubing string 18 defined by the gas lift mandrels 22 and, particularly, the resistance of the portions of the gas lift mandrels 22 between the respective contactors 48 and 52 of each gas lift valve assembly 42.

The method of this invention also contemplates the measurement of current flowing through the respective gas lift mandrels **22*a*, 22*b* and 22*c*, as indicated in FIG. 2 by way of example. In order to measure this current with the system and method of the invention, it is necessary to determine the resistance of the gas lift mandrels 22*a*, 22*b* and 22*c* between their respective electrodes 48 and 52 of each gas lift valve assembly. A change in current flow in the tubing 18 between each mandrel 22*a*, 22*b* and 22*c* from one time of measurement to another may be correlated with a change in resistance of a section of tubing interposed between the respective gas lift valve assemblies and between the gas lift valve assembly in mandrel 22*a* and the wellhead 16. It is assumed that some current will leak off from the casing 14 into the formation 12 toward the electrode or conductor 34. These currents are indicated in FIG. 2** as $I_{fa}$, $I_{fb}$, $I_{fc}$ and so on.

Initially, the resistivity of each gas lift mandrel 22 is determined in accordance with the method described below. The meters 70 will each have a suitable resistance, substantially greater than the resistance of the mandrels 22 between the contactors 48 and 52 when the gas lift assemblies 42 are suitably installed in the mandrels, respectively. The resistance of each of the mandrels 22 is initially determined by placing the voltage source 76 in circuit with the meter 70 and the gas lift mandrel 22 between the contactors 48 and 52 by closure of the switch 74. Current, $I_{76}$, is measured at the meter 70 and, since the voltage $V_{76}$ of source 76 is known, the total resistance, $R_T$ of the circuit including the gas lift mandrel between the contactors 48 and 52 is calculated from the equation:

$$R_T=V_{76}\div I_{76}.$$

Moreover, $$V_{76}=V_{60}+V_{22}.$$

$V_{60}$ is the voltage drop throughout the circuit 60 just described except for the voltage drop through the mandrel 22 between the contactors 48 and 52 and $V_{22}$ is the voltage drop through the mandrel 22 between the contactors. Moreover, $$V_{60}=(I_{76})\cdot(R_{60}).$$

$R_{60}$ includes all resistances except that of the mandrel 22 between the contactors 48 and 52 and can be predetermined. Accordingly, $$V_{22}=V_{76}-(I_{76\cdot R60}).$$

Thus, the voltage drop through the mandrel 22 between the contactors 48 and 52 is known from the above measurements and calculations, and the resistance $R_{22}$ between the contactors 48 and 52 can be calculated from the equation:

$$R_{22}=V_{22}\div I_{76}.$$

Since the resistance at each of the mandrels 22, such as 22*a*, 22*b*, and 22*c*, is now known after measurement by their respective circuits 60, the switch 74 may be opened and the switch 72 closed so that a voltage drop across the contactors 48 and 52 may be measured when the current source 32 is connected to the circuit indicated in FIG. 2. With current flowing down through the tubing string 14, 18 the voltage drop across each of the mandrels 22*a*, 22*b* and 22*c* can be measured by the respective circuits 60 associated with the gas lift valve assemblies 42 disposed in each of the mandrels. Since the voltage drop across each of the sets of contactors 48 and 52 is measurable by the respective meters 70, and the resistance, $R_{22}$, of each of the mandrels 22 between their respective sets of contactors has been previously determined, the current flow at each mandrel 22*a*, 22*b*, 22*c* and so on may be calculated from the voltage measurements and the known resistances at the respective mandrels. Moreover, the current input to the conductor comprising the combined casing and tubing 14, 18, at the wellhead 16 or otherwise at the surface directly adjacent the upper ends of the tubing and casing, may be measured at the meter 38 and may be, for example, assumed to be current $I_{38}$. It is known that some current will leak off into the formation such as $I_{fa}$. However, it is assumed that the resistances of the formation zones through which currents $I_{fa}$, $I_{fb}$, $I_{fc}$ are flowing will not change, and it is assumed that corrosion of the casing 14 is minimal.

Accordingly, any change in the currents flowing between the wellhead 16 and gas lift mandrel 22*a*, or between gas lift mandrels 22*a* and 22*b*, or between gas lift mandrels 22*b* and 22*c*, and so on, will be due to an increase in corrosion of the tubing string 18 between the surface 13 and the uppermost mandrel 22*a* or the respective pairs of gas lift mandrels. For example, the difference in current flowing at gas lift mandrels 22*a* and 22*b* ($I_{22a}-I_{22b}$) should be $I_{fb}$. Therefore any change in this current difference may be accounted for as a change in resistance $R_{18b}$ in the tubing section between the mandrels 22*a* and 22*b*, due to corrosion. A set of measurements of current from the source 32 may be made at each mandrel 22*a*, 22*b*, 22*c* and so on, initially, when the system of the invention is installed. In other words, the difference between currents $I_{22a}$ and $I_{22b}$ at time $t_1$ would be proportional to the resistance, $R_{18b}$. The difference between currents calculated from measurements at mandrels 22*a* and 22*b* taken at a later time, $t_2$, if different than the difference in the currents measured initially, would indicate that a change in resistance $R_{18b}$ had occurred in the tubing section between mandrels 22*a* and 22*b* due to corrosion therein.

The above-described sets of measurements and calculations may be carried out for current flowing between wellhead 16 and mandrel 22*a* and between each pair of mandrels 22 adjacent to each other throughout the length of the tubing string 18 to determine if corrosion is taking place in the mandrels themselves and/or in the tubing string sections between the mandrels. The system and method of the invention just described is conveniently carried out for wells which include spaced apart gas lift mandrels of the type described and modified gas lift valve assemblies of the type described herein, including the gas lift valve assembly 42. These measurements and calculations can be conveniently made by placing the modified gas lift valve assemblies in selected ones of the mandrels 22, for example, at will, and retrieving these valve assemblies when desired. The gas lift valve assemblies 42 themselves do not have to be operable gas lift valves and can be so-called dummy valves or bodies which simply are operable to fit in the recesses 33 and carry the signal transmitters 58 or 80, the controller 62, if required, signal processor 64 and the circuit 60.

Figure 6:
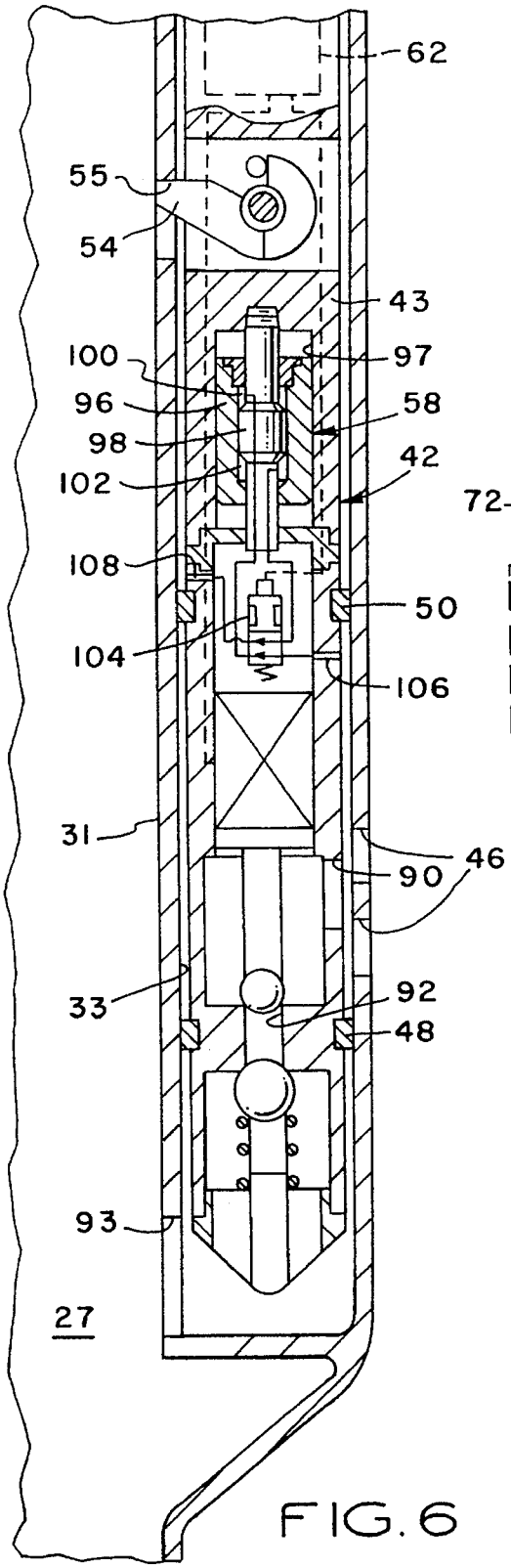
FIG. 6 is a detail section view of a portion of the gas lift valve assembly shown in FIG. 3.

Referring to FIG. 6, further details of a gas lift valve assembly 42 are shown including the signal transmitter 58 which is operable to send a coded acoustic or stress wave-type signal up through the tubing string 18 to the sensor 24. The transmitter or actuator 26 is also operable to transmit signals down to respective ones of the mandrels 22 and their associated gas lift valve assemblies for operation of the associated circuits 60. The gas lift valve assembly 42 is characterized by the elongated tubular body 43 which may be made up of several component parts and is operable to support the latch 54 for registration in a slot 55 in the wall 31. Pressure gas enters the ports 46 and flows through a suitable port 90 in the body 43 and then through a passage 92 to exit through a port 93 into the passage 27. Conventional components of the gas lift assembly 42 are illustrated in FIG. 6 but do not require further description herein.

However, the gas lift valve assembly 42 includes the unique signal transmitter 58 which comprises a reciprocating mass 96 slidably disposed in a bore 97 in sleeved relationship around a stationary piston 98 and defining opposed pressure fluid receiving chambers 100 and 102. Pressure fluid is transmitted selectively to and vented from the chambers 100 and 102 by a solenoid controllable valve 104 which may, for example, receive pressure gas from the ports 46 by way of a passage 106 to pass through the valve 104. Pressure gas may be exhausted from the signal transmitter 58 through a suitable passage 108 to flow into the passage 27 from the recess 33. The valve 104 is controlled by the controller 62 in a suitable manner which may be in accordance with the teaching of U.S. Pat. No. 5,319,610.

Figure 5:
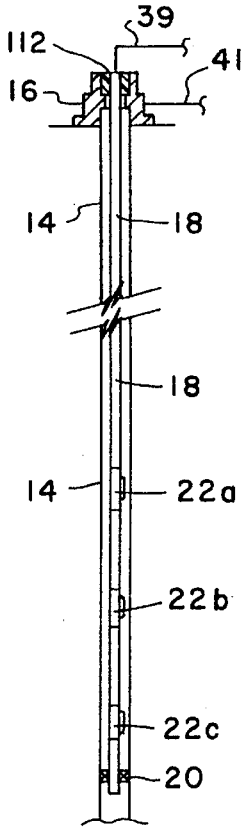
FIG. 5 is a diagram of a well having a tubing string disposed therein which is not in substantial contact with the well casing.

Referring briefly to FIG. 5, the system and method of the invention may also be carried out in a well such as the well 110 wherein the tubing string 18 is not in electrically conductive contact with the casing 14 except at a suitable packer, such as the packer 20. Moreover, if the tubing string 18 is electrically insulated from the wellhead 16, such as by suitable insulator 112, then the current source 32 may be connected to the tubing string 18 and the casing 14 instead of to the electrode or conductor 34. The change in current flow between the wellhead 16 and the mandrel 22*a* or between any two of the mandrels 22*a*, 22*b* and 22*c*, for example, may be determined in the same manner described above for the well 10 whereby a change in resistance of a section of the tubing string 18 may be detected and related to increasing corrosion thereof. Moreover, in carrying out the method of the invention on a well, such as the well 110, corrosion on the casing 14 may also be measured which could be determined from a change in the resistance of the casing 14. The arrangement illustrated in FIG. 5 is a somewhat idealized condition wherein the tubing string 18 is not in electrically conductive contact with the casing 18. In relatively deep and even true vertical wells, for example, the tubing string 18 is, however, likely to make electrically conductive contact with the casing 14 at one or more points throughout its length.

As mentioned previously, efforts to measure corrosive activity in tubing strings which extend within wells which pump fluid to the surface using a rod actuated pump or an electrical submersible pump, for example, may also enjoy the benefits of the invention. Such wells may be modified to include tubing strings which have mandrels similar to the mandrel 22 interposed therein at spaced apart intervals. So-called dummy valves or bodies having the circuit illustrated in FIG. 4 and a transmitter of the type illustrated in FIG. 6 may be interposed in these bodies and they may be placed in selected one of such tubing mandrels. Accordingly, the benefits of the present invention may be enjoyed by tubing strings extending within wells which do not require gas lift. Still further, those skilled in the art will appreciate that other types of metal conduits which are generally inaccessible or are not desired to be taken out of service, such as fluid transmission pipelines, may be modified to have bodies similar to the gas lift valve assemblies 42 interposed therein at spaced apart points and which are capable of measuring the same parameters as described herein with respect to the pipeline.

Figure 7:
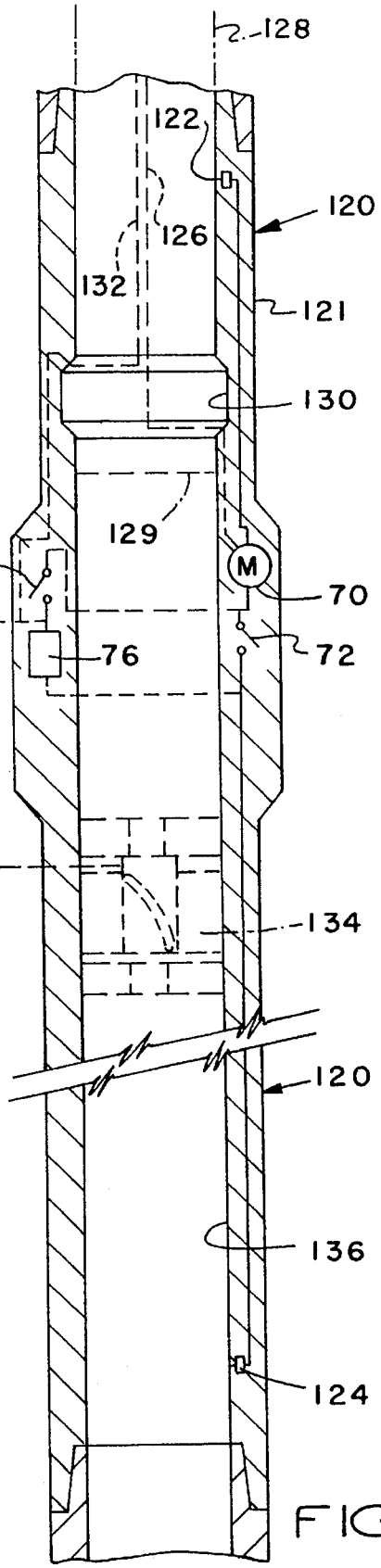
FIG. 7 is a detail view of a section of tubing string modified for making corrosion measurements in accordance with an alternate embodiment of the system of the invention.

The system and method of the invention may be utilized in conjunction with well tubing strings and conduits, such as fluid transmission pipelines, wherein gas lift mandrels and gas lift valve assemblies are not utilized. Referring to FIG. 7, for example, there is illustrated a portion of a well tubing string 120 which includes a tubing section 121 modified to include the circuit 60 therein, including the meter 70, switch 72, constant voltage source 76 and switch 74. The circuit shown in FIG. 7 includes contactors or electrodes 122 and 124 disposed at spaced apart points in the tubing section 121. The signals generated by the meter 70, while measuring voltage drop between the contactors 122 and 124, as well as when measuring current flow between the contactors 122 and 124 may be transmitted to the surface by suitable conductor means 126 interposed in a coiled tube 128 which may be run into the tubing 120 and releasably locked into a cooperating recess 130. The tube 128 is provided with a suitable head 129 and contactors formed thereon, not shown, which are cooperable with contactors disposed in recess 130, also not shown, for transmitting signals between the circuit 60 and the surface through the tube 128. A suitable source of electric energy may be placed in communication with the battery type voltage source 76 by way of conductor means 132 in the tube 128 also, when desired. In fact, while measurements are being made the current source for use in carrying out the method may be that which is provided through conductor means 132 in place of the source 76.

Moreover, a suitable fluid driven electrical generator 134 may be interposed in the flow passage 136 of the tubing section 121 for generating suitable power to maintain the battery source 76 at a desired condition. Plural tubing sections 121 may be interposed in tubing string 120 at spaced apart intervals throughout the length of the tubing string to carry out the corrosion detection method of the invention. The tubing string 120 may be interposed in either the well 10 or 110 in place of the respective tubing strings shown in those wells and suitably connected to the source 32 for making the measurements required.

Figure 8:
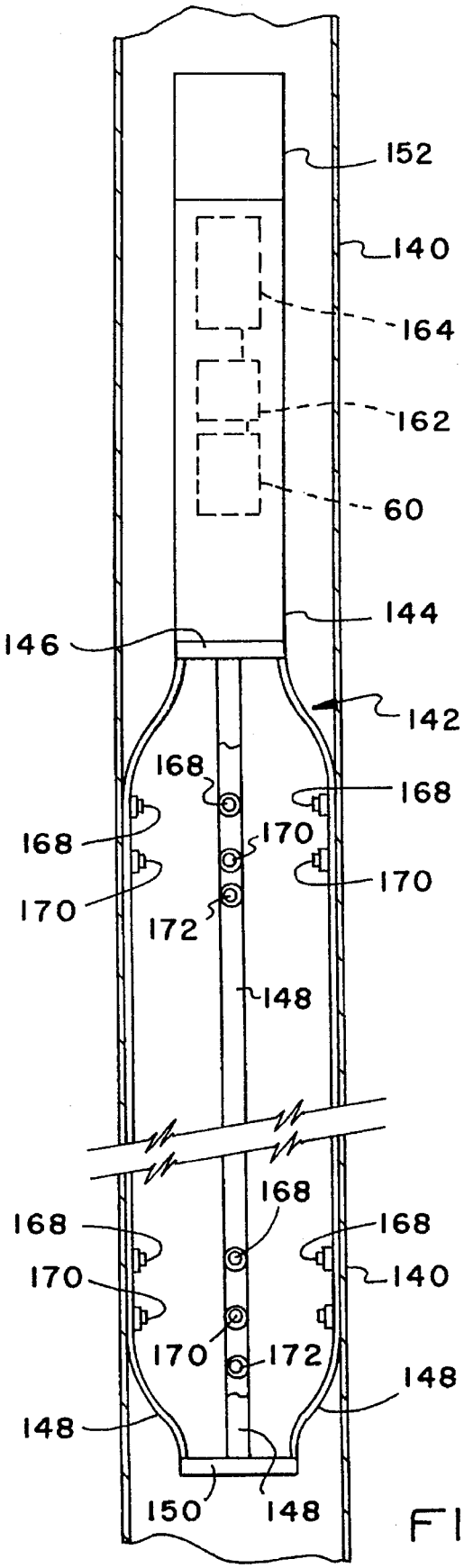
FIG. 8 is a detail view of another alternate embodiment of a system for making measurements in accordance with the invention.
Figure 9:
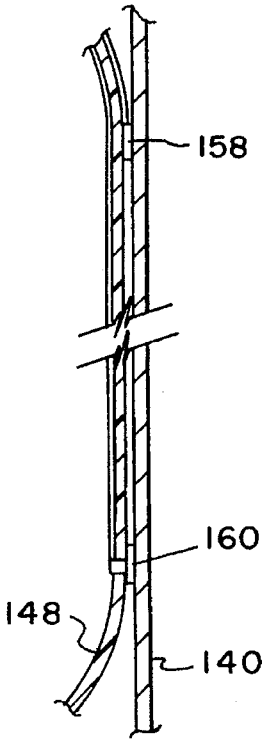
FIG. 9 is a detail view showing one arrangement of contactors for engagement with a tubing or conduit for the system of FIG. 8.

Referring now to FIGS. 8 and 9, there is illustrated a section of a tubing string 140 which may be interposed in a well such as the well 10 or 110 in place of the tubing string 18 and having a retrievable instrument apparatus 142 interposed therein for making certain measurements including the voltage and current flow measurements described above. The apparatus 142 includes a body or housing 144 connected to a generally cylindrical ring member 146 which has four circumferentially spaced, elongated elastic band members 148 connected thereto. The band members 148 extend to a distal cylindrical ring member 150 at the opposite ends thereof. The band members 148 are elastically deflectable radially inwardly and outwardly whereby the instrument apparatus 142 may be deployed in the tubing string 140 at selected points by ejection from and retrieval into a suitable conveying sleeve, not shown, which may comprise the distal end of a coilable tube, also not shown. A conventional landing nipple 152 is connected to the body 144 at the upper end thereof, as illustrated, for allowing the apparatus 142 to be run into and retrieved from the tubing string 140 by a conventional running tool, not shown. Current flow and resistance measurements may be taken by a circuit 60 disposed in the body 144, which includes the aforementioned components of the meter 70, the voltage source 76 and the switches 72 and 74, whereby voltage and current measurements may be taken along the tubing string 140 between spaced apart electrodes 158 and 160, suitably mounted on one of the bands 148, as illustrated, in place of the contactors 48 and 52, for example. The bands 148 are preferably substantially non-electrically conductive and thus a voltage drop and current flow may be measured along the tubing string 140 between the electrodes or contactors 158 and 160 and the method of the invention may be carried out accordingly.

The operation of the circuit 60 may be controlled by a suitable controller 162 disposed on the apparatus 142 and readings taken from the circuit 60 may be stored in a suitable memory 164 also disposed on the body 144. The apparatus 142 may include suitable sensors 168, 170 and 172, for example, for measuring the properties of fluids flowing through the tubing string 140 in accordance with the teaching of U.S. patent application Ser. No. 08/276,976. Accordingly, the apparatus 142 may be positioned at selected points in the tubing string 140 and readings taken of voltage drop and current flow between the electrodes or contactors 158 and 160 whereby changes in current flow imposed on the tubing string 140 by the source 32 may be used to determine corrosion of the tubing string 140 between the measurement points.

The method of determining corrosion of the tubing strings 120 and 140 is essentially the same as the method described above for determining corrosion in the tubing string 18. By placement of the circuit 60 in circuit with the contactors 122 and 124 of the tubing string 120 or the contactors 158 and 160 of the apparatus 142, the initial resistance of the respective tubing strings between the contactors may be determined, the current flow through the tubing strings, respectively, may be measured and any changes in resistance in the tubing strings between the points of measurement may be determined. The instrument apparatus 142 may, of course, be placed at selected positions in the tubing string 140 or a similar tubing string, including a surface or subsurface pipeline, measurements made and the assembly then left in place or retrieved from the tubing string. The tubing section 121 may be placed at selected intervals in a tubing string 120 whereby the aforementioned method may be carried out. The generator 134 may, of course, only be interposed in a tubing section 121 which does not require extension of wellbore tools or the coilable tubing 128 or other devices completely therethrough.

Although preferred embodiments of methods and systems in accordance with the invention have been described in detail herein, those skilled in the art will recognize that various substitutions and modifications may be made without departing from the scope and spirit of the appended claims.

What is claimed is:

1. A method for detecting corrosion in a tubing extending within a wellbore comprising the steps of:

(a) imposing a predetermined voltage potential between spaced apart contactors in contact with said tubing at a first interval in said tubing;

(b) measuring the current flow through said tubing at said first interval between said contactors;

(c) calculating the resistance of said tubing at said first interval between said contactors;

(d) imposing a predetermined voltage potential across said tubing at a second interval in said tubing spaced from said first interval and between spaced apart contactors;

(e) measuring the current flow through said tubing at said second interval between said contactors and calculating the resistance of said tubing at said second interval between said contactors;

(f) connecting a current source to said tubing and measuring the voltage drop between said contactors at said first interval in said tubing and said second interval in said tubing and determining current flow at said first interval and said second interval based on the measured voltage drop and the known resistance of the tubing at said first interval and said second interval and noting the difference between current flows at said first interval and said second interval; and (g) at a later time, repeating step (f) to determine the difference in current flows at said first interval and said second interval and comparing such differences in current flows to detect corrosion in said tubing between said first interval and said second interval.

2. The method set forth in claim 1 including the steps of:

repeating steps (a) through (e) at said later time prior to repeating step (f) to determine any change in resistance of said tubing at said first interval and said second interval, respectively.

3. The method set forth in claim 1 wherein:

said tubing is in electrically conductive contact with an earth formation penetrated by said well and said current source is connected between said tubing and said earth formation penetrated by said well.

4. The method set forth in claim 1 wherein:

said tubing includes a plurality of gas lift mandrels spaced apart therein and said measurements of current flow and voltage drop are carried out across contactors engaged with said gas lift mandrels at spaced apart points therein, respectively.

5. The method set forth in claim 4 including the steps of:

transmitting signals between said gas lift mandrels and the earth's surface related to the measured values of voltage drop and current at said gas lift mandrels, respectively.

6. The method set forth in claim 5 wherein:

said signals are transmitted between said gas lift mandrels and the earth's surface by transmitter means disposed on said gas lift mandrels, respectively.

7. The method set forth in claim 6 wherein:

said signals are transmitted to the earth's surface by stress waves imposed on said tubing by said transmitter means.

8. The method set forth in claim 6 including the step of:

transmitting signals between said gas lift mandrels and the earth's surface by electromagnetic waves.

9. The method set forth in claim 8 including the step of:

generating said waves between said contactors.

10. The method set forth in claim 1 including the steps of:

providing a circuit interposed in said tubing including current sensitive meter means for measuring current flow and said voltage drop, respectively, and signal transmitter means for transmitting signals related to said measured current flow and voltage drop, respectively, to the surface; and transmitting said signals related to current flow and voltage drop measured by said circuit to the earth's surface at selected intervals of time.

11. The method set forth in claim 1 wherein:

said tubing has plural spaced apart tubing sections interposed therein, each of said tubing sections including spaced apart contactors in communication with means for measuring current flow and voltage drop between said contactors and a source of predetermined voltage potential operable to be placed across said contactors to generate a measurable current whereby the resistance of said tubing section may be selectively measured.

12. The method set forth in claim 1 including the steps of:

providing an apparatus including a source of said predetermined voltage potential, means for measuring current flow and voltage drop between said contactors, said apparatus including said contactors formed thereon, and selectively positioning said apparatus in said tubing at said first interval and said second interval and engaging said contactors with said tubing at said intervals, respectively, and measuring voltage drop between said contactors engaged with said tubing and current flow between said contactors when engaged with said tubing at said intervals, respectively.

13. The method set forth in claim 1 wherein:

said current source imposed on said tubing is a switched DC voltage source having a frequency of from about 0.01 Hz to 10 Hz and a voltage of from about 100 microvolts to 1000 microvolts.

14. The method set forth in claim 13 wherein:

said current source is operable to impose a current of from about 1.0 amps to 100 amps on said tubing string.

15. The method set forth in claim 1 wherein:

said predetermined voltage potential imposed between said contactors in step (a) is a constant DC voltage.

16. A method for determining corrosion in a metal tubing string extending within a well penetrating an earth formation, said well including a metal casing and said tubing string being in contact with said casing, comprising the steps of:

placing a circuit in said tubing string at selected spaced apart points in said tubing string, said circuit including a current sensitive meter and a first voltage source;

imposing said first voltage source across a first interval of said tubing string and measuring the current flow through said first interval with said meter;

placing said first voltage source across said tubing string at a second interval spaced from said first interval and measuring the current flow through said tubing string at said second interval with said meter;

determining the resistance of said tubing string at said first interval and said second interval based on the voltage of said first voltage source and the currents measured at said intervals, respectively;

imposing a second voltage source at the surface of said well on said casing and at a conductor penetrating said earth formation at a preselected distance from said well;

measuring the voltage drop across said first interval and said second interval in said tubing string and determining the current flow across said first interval and said second interval based on said measured voltage drops, respectively; and comparing the current flows across said first interval and said second interval.

17. The method set forth in claim 16 including the steps of:

at a later time after the time at which said voltage drop measurements were made across said first interval and said second interval again measuring voltage drop across said first interval and said second interval in said tubing string;

determining current flow at said first interval and said second interval based on said voltage drop across said first interval and said second interval and the resistance of said tubing string across said first interval and said second interval between said contactors, respectively; and comparing the differences in current flows at said first interval and said second interval from said first mentioned measurements and said second mentioned measurements.

18. The method set forth in claim 17 including the step of:

imposing said first voltage source across said contactors at said first interval and said second interval and measuring the current flow between said contactors at said first interval and said second interval, respectively, to determine any change in resistance of said tubing string at said first interval and said second interval prior to making measurements of the voltage drops across said first interval and said second interval at said later time.

19. A method for detecting corrosion in a metal conduit comprising the steps of:

(a) imposing a predetermined voltage potential between spaced apart contactors in contact with said conduit at a first interval in said conduit;

(b) measuring the current flow through said conduit at said first interval between said contactors;

(c) calculating the resistance of said conduit at said first interval between said contactors;

(d) imposing a predetermined voltage potential across said conduit at a second interval between spaced apart contactors;

(e) measuring the current flow through said conduit at said second interval between said contactors and calculating the resistance of said conduit at said second interval between said contactors;

(f) connecting a current source to said conduit and measuring the voltage drop between said contactors at said first interval in said conduit and said second interval in said conduit and determining current flow at said first interval and said second interval based on the measured voltage drop and the known resistance of the conduit at said first interval and said second interval and noting the difference between current flows at said first interval and said second interval; and (g) at a later time, repeating step (f) to determine the difference in current flows at said first interval and said second interval and comparing such differences in current flows to detect corrosion in said conduit between said first interval and said second interval.

20. A system for determining corrosion of a tubing string extending within a well comprising:

a circuit including a current sensitive meter, a first voltage source and a pair of spaced apart contactors operable to be in conductive engagement with a section of tubing string at spaced apart points thereon, said circuit including switch means for placing said current sensitive meter in communication with said contactors for measuring a voltage drop through said section of tubing string between said contactors and switch means for placing said first voltage source in communication with said meter and said section of tubing string through said contactors so that selective measurements of current flow through said tubing string between said contactors and a voltage drop through said tubing string between said contactors may be carried out, said circuit being disposed on means for deploying said circuit to a predetermined position in said tubing string for making said measurements of voltage drop and current flow through said section of tubing string between said contactors.

21. The system set forth in claim 20 wherein:

said circuit is disposed in a body adapted to be placed in a gas lift mandrel interposed in said tubing string and said contactors are disposed on said body at spaced apart points thereon for electrically conductive contact with said gas lift mandrel.

22. The system set forth in claim 20 including:

a second voltage source adapted to be connected to said tubing string and one of a casing disposed around said tubing string and a conductor disposed in the earth at a point spaced from said casing.

23. The system set forth in claim 21 wherein:

said body includes a gas lift valve disposed therein for communicating pressure gas through said body to said tubing string.

24. The system set forth in claim 21 wherein:

said body includes a signal transmitter interposed therein and operable to transmit signals related to said voltage drop and said current measured by said circuit through said tubing string to sensor means associated with said tubing string for receiving said signals.

25. The system set forth in claim 20 including:

a signal transmitter disposed in said tubing string and operable to transmit signals related to said voltage drop and said current measured by said circuit to the earth's surface.

26. The system set forth in claim 25 wherein:

said signal transmitter includes means operable to generate electromagnetic wave energy for transmission to the earth's surface from a point between said contactors.

27. The system set forth in claim 20 wherein:

said circuit is interposed in a section of said tubing string and said contactors are spaced apart on said section of said tubing string for measurement of voltage drop and current flow therebetween through said section of said tubing string.

28. The system set forth in claim 20 wherein:

said section of tubing string includes a recess for receiving conductor means for transmitting signals between said meter and the earth's surface.

29. The system set forth in claim 28 wherein:

said section of tubing string includes means for conducting charging current to said first voltage source.

30. The system set forth in claim 29 wherein:

said section of tubing string includes an electrical generator interposed therein and operable to provide charging current to said first voltage source in response to operation of said generator by fluid flow through said tubing string.

31. The system set forth in claim 20 wherein:

said circuit is disposed on a body insertable in said tubing string, said body is connected to an elongated support member for supporting spaced apart contactors engageable said tubing string for making measurements of voltage drop and current flow through said tubing string between said contactors.

32. The system set forth in claim 31 wherein:

said support member is elastically deflectable to provide for traversing said system through said tubing string between a first interval and a second interval in said tubing string for measuring said voltage drop and said current flow, respectively.

* * * * *